United States Patent [19]

Clark et al.

[11] 3,986,965

[45] Oct. 19, 1976

[54] ESTER BASE LUBRICATING COMPOSITIONS HAVING IMPROVED OXIDATIVE RESISTANCE

[75] Inventors: Frank S. Clark; Stanley L. Reid, both of St. Louis, Mo.

[73] Assignee: Monsanto Company, St. Louis, Mo.

[22] Filed: Oct. 31, 1975

[21] Appl. No.: 627,566

[52] U.S. Cl. ..... 252/32.5; 252/49.8; 252/75

[51] Int. Cl.[2] ..... C10M 1/44; C10M 3/38; C10M 5/24; C10M 7/24

[58] Field of Search ..... 252/32.5, 49.8, 75

[56] References Cited

UNITED STATES PATENTS

| | | | |
|---|---|---|---|
| 3,684,711 | 8/1972 | Thompson et al. | 252/32.5 |
| 3,720,612 | 3/1973 | Bosniack et al. | 252/32.5 |
| 3,914,179 | 10/1975 | Byford et al. | 252/32.5 |

*Primary Examiner*—Delbert E. Gantz
*Assistant Examiner*—I. Vaughn
*Attorney, Agent, or Firm*—William H. Duffey

[57] ABSTRACT

The oxidation resistance of synthetic ester base functional fluids is enhanced by incorporating in the fluid small amounts of triphenylphosphine or triphenylphosphine oxide together with a complex alkali metal organophosphorus compound.

11 Claims, No Drawings

ESTER BASE LUBRICATING COMPOSITIONS HAVING IMPROVED OXIDATIVE RESISTANCE

This invention was made in the course of, or under, a contract with the United States Department of the Air Force.

BACKGROUND OF THE INVENTION

1. Field of the Invention

This invention relates to synthetic ester base functional fluid compositions which are useful as jet engine lubricants, heat transfer fluids, hydraulic fluids and the like, especially at high temperatures. More specifically, the present invention relates to synthetic ester base stocks which have achieved improved oxidative stability through the incorporation of triphenylphosphine or triphenylphosphine oxide together with a complex alkali metal organophosphorus compound.

2. Description of Prior Art

The continuing development and improvement of high performance aircraft gas turbine engines has created a continual demand for improved lubricants which are efficient over a wide range of operating temperatures and which are resistant to oxidative and thermal degradation. Aircraft gas turbine engines in particular are found to operate with greater efficiency at higher gas temperatures. Higher gas temperatures necessarily result in higher lubricant temperatures in the hot section of the engine. Consequently, emphasis on improved gas turbine lubricants has usually been directed toward their high temperature properties.

The special requirements of gas turbines have led to the development of synthetic lubricants, the most prevalent being polyesters formulated from hindered alcohols such as pentaerythritol, dipentaerythritol and mixtures thereof. These synthetic esters usually form the lubricant base stock to which various compounds are added to enhance and control such properties as viscosity, corrosivity, oxidation stability, foaming, flammability, extreme pressure properties and loadbearing capability.

Oxidative stability of the synthetic esters is reflected in the change in viscosity and corrosivity of the material after exposure to air at elevated operating temperatures. Typically, uninhibited lubricant formulations show large increases in both viscosity and corrosivity as a result of oxidation.

Numerous oxidation and corrosion inhibitors have been found useful in ester base lubricating compositions. For example, antioxidants such as phenothiazine, phenyl-1-naphthylamine, diaromatic secondary amines, and mixtures of alkali metal salts of carboxylic acids with arylamines are well known in the art. Many stabilizers, however, have one or more deficiencies which limit their use and make them unsatisfactory for current needs. Quite often, these inhibitors either do not provide adequate oxidation resistance for modern high performance, high temperature gas turbines, or they adversely affect other critical properties such as load-bearing capacity.

Alkali metal salts are known to inhibit high temperature oxidation of organic fluids. Those salts which are soluble enough in ester base stocks to be effective often tend to cause excessive foaming and sometimes react with the esters to form insoluble salts.

Illustrative of the steadily increasing demands being placed upon gas turbine engine lubricants is the upward progression of bulk oil temperature limits in Military Specifications as follows:

| | |
|---|---|
| Specification MIL-L-7808 | −54° C. to +163° C. |
| Specification MIL-L-23699 | −40° C. to +177° C. |
| Specification MIL-L-27502 | −40° C. to +240° C. |

Specification MIL-L-27502 is applicable to synthetic lubricants visualized for advanced gas turbine engine designs. Synthetic fluids now available under the earlier specifications are known to experience excessive deposit formation and degradation in the range of 177° C. to 240° C. Development of a formulated ester base lubricant meeting the rigorous demands of MIL-L-27502 was an object of the present invention.

U.S. Pat. No. 3,684,711, issued Aug. 15, 1972, discloses a deposit inhibitor for synthetic ester base lubricants. That deposit inhibitor comprised a complex alkali metal organophosphorus compound prepared by esterifying a polyhydric alcohol free of beta hydrogen with a carboxylic acid or acid derivative and a phosphorus acid or acid derivative. The resulting complex organophosphorus ester was thereafter contacted with an alkali metal base.

It is an object of the present invention to provide certain oxidation inhibitors which cooperate with the deposit inhibitors of U.S. Pat. No. 3,684,711 in an ester base stock to produce a gas turbine engine lubricant capable of operation at bulk oil temperatures of 240° C. without excessive formation of engine deposits and without excessive viscosity increase. A further object of the present invention is to provide an oxidatively stable synthetic lubricant as described above which exhibits satisfactory storage life. Still another object of the present invention is to provide inhibitors for esterbase lubricants which do not adversely affect the load-bearing properties of the lubricants. Still another object is to provide superior lubricants for modern high performance, high temperature gas turbine engines.

SUMMARY OF THE INVENTION

Synthetic ester base lubricants and particularly the lubricants derived from pentaerythritol and polypentaerythritol are stabilized against oxidation and deposit formations at elevated temperatures by incorporating in the ester certain additives. More specifically, the present invention is directed to a composition useful as a lubricant comprising A. a major amount of a synthetic lubricant base stock which is an ester of a polyol and a $C_4$ to $C_{22}$ carboxylic acid;

B. an oxidation inhibiting amount of triphenylphosphine or triphenylphosphine oxide; and C. a deposit inhibiting amount of a complex alkali metal organophosphorus compound wherein the atomic ratio of alkali metal to phosphorus is at least 0.8:1, said compound being the salt of an alkali metal base and a complex organophosphorus esterification product which is an acid ester of (i) a polyhydric alcohol free of beta-hydrogen atoms, (ii) a $C_4$ to $C_{22}$ acylating agent, and (iii) a polybasic phosphorus compound selected from the group consisting of (a) free acids of phosphorus selected from the group consisting of phosphoric acid, phosphorous acid and lower alkyl phosphonic acid (b) esters or partial esters of phosphoric acid, phosphorous acid and lower alkyl phosphonic acid and (c) amides of phosphorous acid and phosphonous acid.

The inhibitors can be prepared separately and added to the ester base stock. The incorporation of the oxidation inhibitor and the deposit inhibitor into synthetic ester base stocks decreases the rate of oxidation of the resulting lubricant at elevated temperatures and does not adversely affect the load-bearing capability, foaming tendencies or viscosity properties of the base stock.

DESCRIPTION OF PREFERRED EMBODIMENTS

The triphenylphosphines employed in the compositions of the present invention can be prepared by the reaction of phosphorus trichloride with an aryl Grignard reagent, i.e., an aryl magnesium halide such as phenyl magnesium chloride. Triphenylphosphine oxide is made by oxidation of triphenylphosphine.

In general, the alkali metal organophosphorus compounds employed as deposit inhibitors in the compositions of this invention are prepared by esterification of a polyhydric alcohol free of beta hydrogen, hereinafter referred to as a polyol, with a slight excess of a mixture of a carboxylic acid and a phosphorus acid or acid derivative, recovering the complex organophosphorus ester product and contacting the ester with an alkali metal base to form a complex alkali metal organophosphorus compound.

The lubricant base stocks of this invention include as a major component an ester of lubricating viscosity which may either be a simple ester or a complex polyester. Included are diesters of dibasic acids and alcohols, diesters of monobasic acids and glycols, and polyesters of monobasic or dibasic acids and polyhydric alcohols.

The preferred base stock esters for this invention are those polyesters derived from polyhydric alcohols free of beta hydrogen such as neo-pentyl glycol, 2-butyl-2-ethyl-1,3-propane diol, trimethylolethane, trimethylolpropane, pentaerythritol, dipentaerythritol, tripentaerythritol, and mixtures thereof. Suitable aliphatic carboxylic acids with which these polyols can be esterified include n- and isobutyric acid and the n-, iso- and neo-isomers of pentanoic, hexanoic, heptanoic, pelargonic, decanoic, lauric, myristic, palmitic, stearic, etc., acids.

The pentaerythritol and dipentaerythritol derived base stocks are particularly preferred for economic reasons as well as their resistance to high temperature oxidation. Typical examples of pentaerythritol and dipentaerythritol base stocks are pentaerythrityl tetrabutyrate, pentaerythrityl tetravalerate, pentaerythrityl tetracaproate, pentaerythrityl dibutyrate dicaproate, pentaerythrityl butyrate caproate divalerate, pentaerythrityl butyrate trivalerate, pentaerythrityl butyrate tricaproate, pentaerythrityl tributyrate caproate. Suitable dipentaerythrityl esters include dipentaerythrityl hexavalerate, dipentaerythrityl hexacaproate, dipentaerythrityl hexaheptanoate, dipentaerythrityl hexacaprylate, dipentaerythrityl tributyrate tricaproate, dipentaerythrityl trivalerate trinonylate and dipentaerythrityl mixed hexaesters of $C_{4-10}$ fatty acids.

Typical examples of triester base stocks are trimethylolpropane tri-n-pelargonate, trimethylolpropane tricaproate, trimethylolpropane tricaprylate and the trimethylolpropane triester of mixed octanoates.

The triphenylphosphine and triphenylphosphine oxide oxidation inhibitors, together with the alkali metal organophosphorus deposit inhibitors, are particularly effective when used in combination with other antioxidants such as the aryl amines. The combined effect of triphenylphosphine or triphenylphosphine oxide, the complex organophosphorus deposit inhibitor, and an aryl amine such as dioctyldiphenylamine, provided a fluid of exceptional stability. Surprisingly, triphenylphosphine and triphenylphosphine oxide not only were compatible with the deposit inhibitors but actually lessened the expected viscosity increase without causing any harmful side effects in the fluid per se. The required concentration of the triphenylphosphine or triphenylphosphine oxide inhibitor is that necessary for oxidation inhibition. Generally, the concentration can range from about 0.01 to 5 percent by weight of the ester base stock, preferably about 0.05 to about 2 percent.

It is desirable and considered to be within the scope of this invention to employ the inhibitors of this invention in combination with other known additives for ester base synthetic functional fluids in order to achieve the optimum combination of properties. Other known additives include, in addition to the aryl amine antioxidants, corrosion inhibitors, viscosity index (V.I.) improvers, extreme pressure (E.P.) agents, foam inhibitors, antiwear agents, dyes and the like.

Aryl amines useful in combination with the inhibitors of this invention include, for example, the diphenyl amines such as diphenyl amine, p-octyldiphenyl amine, p,p′-dioctyldiphenyl amine, and the like; alkylated phenyl-α-naphthylamine, dioctyl phenyl-1-naphthylamine, N-phenyl-naphthylamines such as N-phenyl-1-naphthylamine, N-phenyl-2-naphthylamine, N-(p-dodecylphenyl)-2-naphthylamine, and the like; dinaphthylamines such as di-1-naphthylamine, di-2-naphthylamine, and the like; phenothiazines including N-alkyl phenothiazine; and N,N′-diphenyl phenylenediamine and dipyridylamines.

Corrosion inhibitors such as aminoindazole, tolyltriazole, dihydroxy anthraquinone, di-t-butyl phenol, disalicylol propylene diamine, and the like; V.I. improvers such as the polymethacrylates; antifoam agents such as the silicone oils; E.P. agents such as phosphorodithioates; and various dyes are all well known additives of the prior art which can be incorporated in combination with the triphenylphosphine and triphenylphosphine oxide oxidation inhibitors of the present invention in order to enhance or control a particular property of the formulated fluid as desired. It is understood, of course, that the complex organophosphorus salt deposit inhibitor is also included within the formulation.

A detailed description for preparing the complex alkali metal organophosphorus salt inhibitors useful in the compositions of this invention can be found in U.S. Pat. No. 3,684,711. Preferred polyhydric alcohols free of betahydrogen which are useful in preparing the organophosphorus deposit inhibitors are selected from the group consisting of neo-pentyl glycol, 2-butyl-2-ethyl-1,3-propane diol, trimethylolethane, trimethylolpropane, pentaerythritol, dipentaerythritol, and mixtures thereof. Preferred acylating agents are selected from the group consisting of mono- and dicarboxylic acids and acid halides, acid anhydrides and esters of mono- and dicarboxylic acids. Preferred alkali metal bases are carbonates, acetates and hydroxides of K, Na, Li, Cs and Rb. A preferred atomic ratio of alkali metal to phosphorus in the complex alkali metal organophosphorus compound is from about 1:1 to about 4:1.

The following examples are provided to illustrate the methods whereby the inhibitors of the present invention are formed and to illustrate the improved properties of the ester base lubricants containing such inhibitors. All parts and percentages in the Examples and Tables are by weight unless otherwise specified.

EXAMPLE I

Preparation of potassium deposit inhibitor

To a 1-liter reactor equipped with a stirrer, reflux condenser and water separator were charged 0.25 mole of tripentaerythritol, 0.25 mole of crystalline phosphorous acid, 0.9 mole 2-ethylhexanoic acid, and 25 ml. toluene. The reactants were brought to vigorous reflux at an initial temperature of 136° C. and the water released during the esterification reaction was separated as formed. After cooling, 0.9 mole of octanoic acid was charged and the esterification continued as the pot temperature rose to 189° C.

When the esterification reaction was complete as indicated by the lack of water of reaction, the reactor pressure was decreased to 1 mm. Hg to remove water, toluene and other volatile materials. A light yellow complex organophosphorous acid ester was decanted from heavier insoluble materials such as polyphosphorous acids.

The complex acid ester (200 g.) in toluene was treated with 0.24 mole of anhydrous potassium carbonate (3 equivalents per equivalent of acid) added in small increments with vigorous agitation. After addition and reaction was complete, the potassium organophosphorus compound was separated from excess carbonate as a clear yellow filtrate.

EXAMPLE II

Preparation of cesium deposit inhibitor

Following the procedure of Example I above, a complex organophosphorus acid ester was made using 0.09 mole of dipentaerythritol, 129.8 grams of Antara LM-400 alkyl acid phosphate, 0.267 mole of 2-ethylhexanoic acid and 0.267 mole of octanoic acid. Antara LM-400 alkyl acid phosphate is commercially available from GAF Corporation. Phosphorous acid (0.2 gram) was used to catalyze the esterification. The acid ester was contacted with cesium carbonate to produce the cesium deposit inhibitor.

EXAMPLE III

This Example describes a typical formulation within the scope of the present invention. The synthetic ester base stock comprised pentaerythritol and polypentaerythritol esters of straight chain fatty acids. To the base stock was added 0.01% of a corrosion inhibitor, 1.0% dioctyldiphenyl amine antioxidant, 1% of a complex potassium organophosphorus compound prepared according to Example I above, and 0.1% of triphenylphosphine or triphenylphosphine oxide oxidation inhibitor. All of the additive concentrations, expressed in weight percentages, are calculated upon the weight of the ester base stock.

EXAMPLE IV

A formulated ester base lubricant composition was prepared in a manner similar to that illustrated in Example III, except that the alkali metal base deposit inhibitor was the cesium compound of Example II. The cesium compound was employed in one-third the concentration as that of its potassium counterpart. In other respects, the formulation of this Example IV was identical to that of Example III.

To illustrate the surprising superiority of triphenylphosphine and triphenylphosphine oxide as oxidation inhibitors in ester base compositions disclosed herein, oxidation-corrosion tests were run with other phosphorus-containing candidates. Table I below illustrates the clear superiority of triphenylphosphine and triphenylphosphine oxide as oxidation inhibitors in the ester base formulations containing either potassium or cesium complex organophosphorus deposit inhibitors. The actual deposit inhibitor employed for each run is signified by "K" for potassium or "Cs" for cesium type. Of particular significance in Table I below is the remarkably low viscosity increase which occurred with the triphenylphosphine and triphenylphosphine oxide oxidation inhibitors. The sludge and coke results with those latter inhibitors were likewise favorable. The oxidation and corrosion tests of this disclosure were conducted at 240° C. according to Federal Test Method Standard 791b Method 5307 with minor modifications.

Viscosity data in Table I was determined according to ASTM Procedure D-445-61.

TABLE I

240° C. OXIDATION-CORROSION TEST RESULTS: OXIDATION INHIBITOR
72 hr, 10 liters air/hr

| /Oxidation Inhibitor (conc.) | | Dep. Inh. | Visc. Inc., % | Ratio, % Visc. Inc. to Std. | Acid No. | Bronze II* Loss, mg/cm² | Deposits |
|---|---|---|---|---|---|---|---|
| (a) | di-i-propyl hydrogen phosphite (0.05%) | Cs | 845.7 | 12.2 | 11.4 | −4.5 | light coke, heavy sludge |
| | | K | 217.5 | 3.1 | 14.5 | −0.6 | very light coke, no sludge |
| (b) | triphenyl phosphite (0.1%) | Cs | 351.5 | 5.1 | 14.1 | −2.8 | light-medium coke, no sludge |
| | | K | 143.9 | 2.0 | 15.1 | −0.5 | no coke no sludge |
| (c) | tris(m-phenoxyphenyl) phosphite (0.1%) | Cs | 177 | 2.6 | 16.2 | −0.9 | light coke no sludge |
| | | K | 97.6 | 1.4 | 12.6 | −0.1 | light coke no sludge |
| (d) | tricresyl phosphate (0.1%) | Cs | 164.2 | 1.5 | 10.8 | −0.8 | no coke, no sludge |
| | | K | 105.9 | 0.98 | 7.0 | −0.3 | very light coke, no sludge |
| (e) | triphenylphosphine (0.1%) | Cs | 30.5 | 0.28 | 4.2 | −0.04 | very light coke, no sludge |
| | | K | 67.5 | 0.91 | 8.1 | −0.08 | light coke, no sludge |
| (f) | triphenylphosphine oxide (0.1%) | Cs | 25.6 | 0.34 | 5.4 | −0.01 | no coke, no sludge |
| | | K | 46.4 | 0.62 | 9.0 | −0.05 | no coke, no sludge |

*Bronze II = Mueller 600, Alloy No. 674

The preceding examples are intended to illustrate variations in the procedures and methods which may be followed in preparing the ester base compositions of this invention. Other modifications within this invention are possible and will be obvious to one skilled in the art having this specification before him. Accordingly, this invention is not to be limited except by the appended claims.

The embodiments in which an exclusive property or privilege is claimed are defined as follows:

1. A composition comprising

A. a major amount of a synthetic lubricant base stock which is an ester of a polyol and a $C_4$ to $C_{22}$ carboxylic acid;

B. an oxidation inhibiting amount of triphenylphosphine or triphenylphosphine oxide; and C. a deposit inhibiting amount of a complex alkali metal organophosphorus compound wherein the atomic ratio of alkali metal to phosphorus is at least 0.8:1, said compound being the salt of an alkali metal base and a complex organophosphorus esterification product which is an acid ester of (i) a polyhydric alcohol free of beta-hydrogen atoms, (ii) a $C_4$ to $C_{22}$ acylating agent, and (iii) a polybasic phosphorus compound selected from the group consisting of (a) free acids of phosphorus selected from the group consisting of phosphoric acid, phosphorous acid and lower alkyl phosphonic acid (b) esters or partial esters of phosphoric acid, phosphorous acid and lower alkyl phosphonic acid and (c) amides of phosphorous acid and phosphonous acid.

2. A composition of claim 1 wherein the polyol of the base stock is selected from the group consisting of neopentyl glycol, trimethylolethane, trimethylolpropane, pentaerythritol, dipentaerythritol, tripentaerythritol, and mixtures thereof.

3. A composition of claim 1 wherein the triphenylphosphine or triphenylphosphine oxide oxidation inhibitor is present in about 0.01 to about 5 percent by weight of the ester base stock.

4. A composition of claim 1 wherein the polyhydric alcohol free of beta-hydrogen is selected from the group consisting of neo-pentyl glycol, 2-butyl-2-ethyl-1,3-propane diol, trimethylolethane, trimethylolpropane, pentaerythritol, dipentaerythritol, tripentaerythritol, and mixtures thereof.

5. A composition of claim 1 wherein the acylating agent is selected from the group consisting of mono- and dicarboxylic acids and acid halides, acid anhydrides and esters of mono- and dicarboxylic acids.

6. A composition of claim 1 wherein the alkali metal base is selected from the group consisting of carbonates, acetates, and hydroxides of K, Na, Li, Cs, and Rb.

7. A composition of claim 6 wherein the polyhydric alcohol is tripentaerythritol, the acylating agent is a fatty acid having from about 4 to about 22 carbon atoms and the polybasic phosphorus compound is phosphorous acid.

8. A composition of claim 6 wherein the polyhydric alcohol is dipentaerythritol, the acylating agent is a fatty acid having from about 4 to about 22 carbon atoms and the polybasic phosphorus compound is an alkyl acid phosphate.

9. A composition of claim 6 wherein the alkali metal base is a potassium salt.

10. A composition of claim 6 wherein the alkali metal base is a cesium salt.

11. A composition of claim 1 wherein the atomic ratio of alkali metal to phosphorus in the complex alkali metal organophosphorus compound (C) is from about 1:1 to about 4:1.

* * * * *